US009788702B1

(12) United States Patent
Zhu et al.

(10) Patent No.: US 9,788,702 B1
(45) Date of Patent: Oct. 17, 2017

(54) DRIPPING MOP

(71) Applicant: Jiaxing Jackson Travel Products Co., Ltd., Jiaxing, Zhejiang (CN)

(72) Inventors: Xue Lin Zhu, Jiaxing (CN); Jing Li, Jiaxing (CN)

(73) Assignee: JIAXING JACKSON TRAVEL PRODUCTS CO., LTD., Zhejiang (CN)

( * ) Notice: Subject to any disclaimer, the term of this patent is extended or adjusted under 35 U.S.C. 154(b) by 42 days.

(21) Appl. No.: 15/099,131

(22) Filed: Apr. 14, 2016

(51) Int. Cl.
*A47L 1/08* (2006.01)
*A47L 13/22* (2006.01)

(52) U.S. Cl.
CPC ..... *A47L 13/22* (2013.01)

(58) Field of Classification Search
CPC ..... A47L 13/22
USPC ..... 401/137–139
See application file for complete search history.

(56) References Cited

U.S. PATENT DOCUMENTS 6,572,711 B2 * 6/2003 Sclafani ..... A47L 7/0009 134/21
6,692,172 B1 * 2/2004 Hsu ..... A47L 13/22 15/104.93
9,687,133 B2 * 6/2017 Zhu ..... A47L 13/42

FOREIGN PATENT DOCUMENTS

CN 2587335 Y 11/2003
CN 2790397 Y 6/2006
CN 104644081 A 5/2015

* cited by examiner

*Primary Examiner* — Jennifer C Chiang
(74) *Attorney, Agent, or Firm* — Muncy, Geissler, Olds & Lowe, P.C.

(57) ABSTRACT

A dripping mop includes a mop head and a mop pole. A dripping control assembly is provided on the mop pole, and includes an inlet conduit, an outlet valve, an outlet conduit, a dripping on/off switch and a dripping limiting switch. The dripping on/off switch has an on state and an off state. In the on state, the mop pole receives a force and displaces towards the mop head to trigger the outlet valve, such that a cleaning liquid is constantly provided for dripping through the outlet conduit. In the off state, the mop pole in the on state again receives a force and displaces towards the mop head to close the outlet valve to suspend the dripping. The dripping limiting switch is rotatable relative to the mop pole, and restrains the mop pole from displacing towards the mop head.

13 Claims, 8 Drawing Sheets

DRIPPING MOP

FIELD OF THE INVENTION

The present invention relates to a mop, and particularly to a mop that performs dripping in response to a trigger.

BACKGROUND OF THE INVENTION

Mops are common cleaning tools in the daily lives. However, during the process of using a mop, a wetted cleaning cloth on the mop may be caused to gradually dry out by the moisture generated during the cleaning process, and needs to be wetted again for further use. Such repeated steps may result in application inconveniences of cleaning staff. Further, after the mop is repeated wetted, the cleaning cloth on the mop may fail to retain water and starts to drip, such that an originally cleaned area may become stained due to the dripping.

A dripping mop is later disclosed by an industrialist. For example, the China Patent No. CN2790397Y discloses a water spraying mop. The water spraying mop is primarily provided with a rotating arm mechanism in a connecting tube, and an inverted bottle at the connecting pipe at an appropriate height from the ground. Through a guiding effect of the tube body, a cleaning liquid stored in the bottle is transported to a spraying head at the front edge of a mop seat, and the flowing of the cleaning liquid out of the bottle is controlled by the rotating arm mechanism.

Further, the China Patent Publication No. 104644081A discloses a mop. The mop of this disclosure includes a mop handle and a mop head. The mop handle includes a water tank at an upper portion and a switch at a middle portion. To apply the mop, the switch at the middle portion is turned on to allow the water in the water tank to flow to the mop head.

Further, the China Patent No. CN2587335Y discloses a mop with a liquid container. In this disclosure, a through hole is axially provided on a connecting rod between a mop pole and a mop head, and one end of a soft tube is penetrated through the through hole to become connected to a water inlet on the mop head. The water inlet is in communication with a water injecting opening. At a position in the connecting rod and corresponding to the through hole, a control switch that turns on and off the water flow in the soft tube in response to a pressing operation on a pressing cover at an upper end of the mop pole is provided.

However, in the above disclosures, a connecting mechanism or a guiding tube mechanism is provided in a mop pole. As such, after the mop pole is assembled, it cannot be readily disassembled. During a transportation process, the mop pole may require special protection to prevent damages, hence disfavoring the transportation process. In addition, in the structures of the above disclosures, maintenance complications may be caused by the connecting structure or guiding tube structure in the mop pole.

SUMMARY OF THE INVENTION

The primary object of the present invention is to solve issues of maintenance and transportation complications of conventional structures.

To achieve the above object, the present invention provides a dripping mop. The dripping mop includes a mop head and a mop pole. The mop pole includes a holding rod, a connecting rod assembled with the mop head, a dripping control assembly connected between the holding rod and the connecting rod, and a water tank connected to the dripping control assembly and storing a cleaning liquid. The holding rod includes a recess at a surface thereof. The dripping control assembly includes an inlet conduit connected to the water tank, an outlet valve connected to the inlet conduit, an outlet conduit connected to the outlet valve, a dripping con/off switch assembled with the holding rod and corresponding to the outlet valve, and a dripping limiting switch corresponding to the holding rod. The dripping on/off switch has an on state and an off state. In the on state, the holding rod receives a force and displaces towards the connecting rod to trigger the outlet valve, such that the cleaning liquid is constantly provided for dripping through the outlet conduit. In the off state, the holding rod in the on state again receives a force and displaces towards the connecting rod to close the outlet valve, such that the dripping is suspended. The dripping limiting switch is rotatable relative to the holding rod, and includes a protrusion corresponding to the recess. When the protrusion is falls in the recess, the holding rod is restrained from displacing towards the connecting rod.

In one embodiment, the dripping on/off switch includes an upper tooth column, a low tooth column corresponding to the upper tooth column, a connecting sleeve accommodating the upper tooth column and the lower tooth column, a restoration spring in the connecting sleeve and accommodating the upper tooth column to drive the upper tooth column to move, and a trigger rod corresponding to the lower tooth column and driven by the lower tooth column to trigger the outlet valve. Each of the upper tooth column and the lower tooth column includes a plurality of channels spaced from one another. The connecting sleeve is provided with at least one guiding rib at the inner edge thereof. During the process of the upper tooth column driving the lower tooth column, the guiding rib rotates the lower tooth column to fall into one of the channels or abuts against the lower tooth column, so as to cause the dripping on/off switch to enter the on state or the off state.

In one embodiment, the dripping on/off switch includes an installation seat connected to the holding rod. The installation seat includes a recessed region at one side facing the upper tooth column. The recessed region is for disposing the upper tooth column therein.

In one embodiment, the dripping mop further includes an outer housing on the mop pole and at least enclosing the dripping on/off switch. Further, the dripping on/off switch includes an installation sleeve corresponding to the trigger rod. The installation sleeve includes a limiting groove at each of two opposite sides thereof. An extension direction of the limiting grooves is orthogonal to an axial direction of the mop pole. The outer housing includes two limiting ribs respectively corresponding to the limiting grooves to restrain the mobility of the outer housing.

In one embodiment, the outer housing includes a first half housing, a second half housing and a lower sealing half housing assembled with one another. The two limiting ribs are disposed in one of the first and second half housings, and extend towards the other. The lower sealing half housing includes a through hole for disposing the outlet conduit therein.

In one embodiment, the dripping on/off switch includes a bridge ring bridged between the connecting sleeve and the installation sleeve.

In one embodiment, the dripping control assembly includes an adaptor bridged between the connecting rod and the outlet valve. The adaptor includes a guiding channel deviating from the axial direction of the mop pole, extending towards the mop head and allowing the outlet conduit to be disposed therein.

In one embodiment, the outer housing includes a tank seat assembled with the two limiting ribs and assembled with one end of the inlet conduit. Further, the outer housing includes a supply valve on the tank seat.

In one embodiment, the mop pole includes a pivoting sleeve accommodating the holding rod and corresponding to the recess. The dripping limiting switch is pivotally disposed on the pivoting sleeve by a pivot axis, and includes a lever member and a pivot member. The pivot member is connected to the lever member, forms a pivotal connection with the pivoting sleeve, and includes the protrusion.

In one embodiment, the recess is a trench surrounding the surface of the holding rod, and the protrusion is a protruding point adapted to fall in the surrounding trench.

Through the above technical solution, the present invention provides following features compared to known technologies. In the present invention, the dripping control assembly is implemented by an alternating switching structure to solve issues of maintenance and transportation complications caused by a connecting mechanism or a guiding tube mechanism in a mop pole of a conventional structure. In addition, with the implementation of the alternating switching structure, continuous dripping can be achieved without having a user pressing a switch for an extended period of time during a cleaning process. After the cleaning process is complete, the dripping can be suspended by having the dripping control assembly enter the off state. Thus, the present invention provides simpler operations and experiences compared to known technologies.

DETAILED DESCRIPTION OF THE PREFERRED EMBODIMENTS

Figure 1:
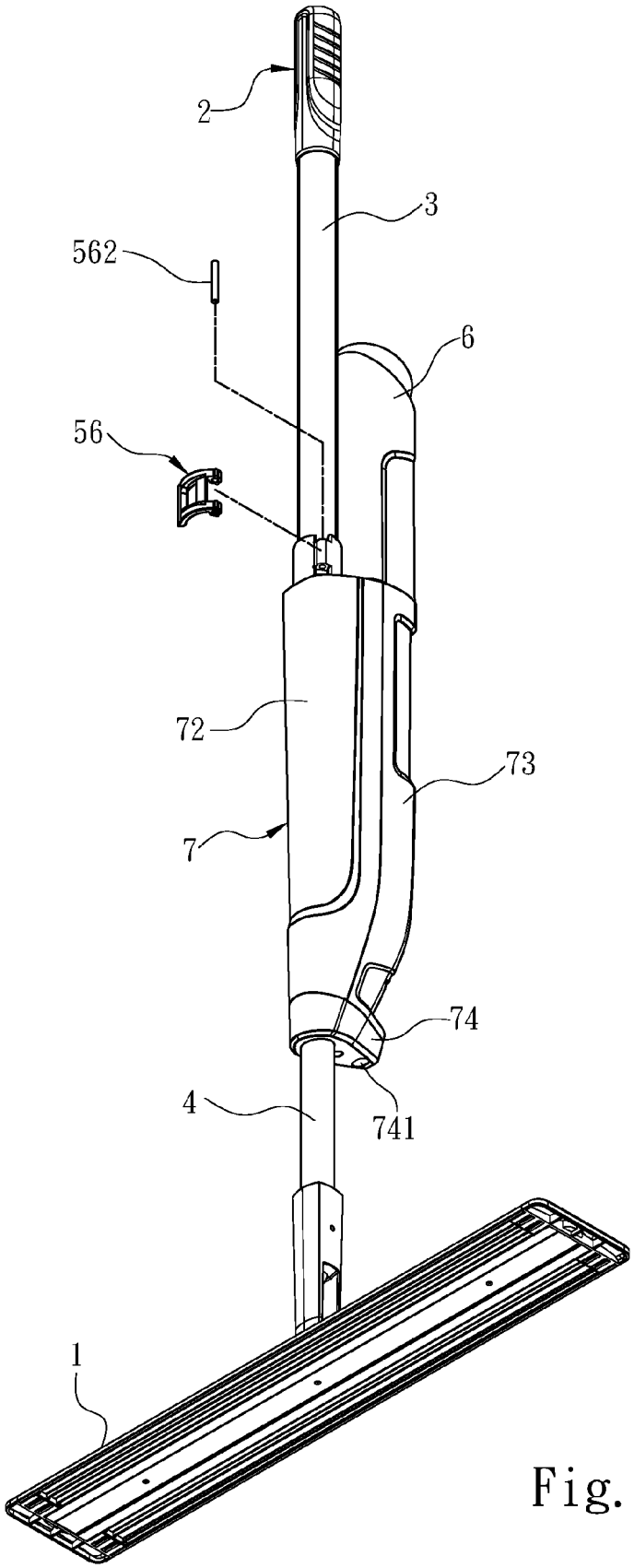
FIG. 1 is a perspective view according to an embodiment of the present invention.
Figure 2:
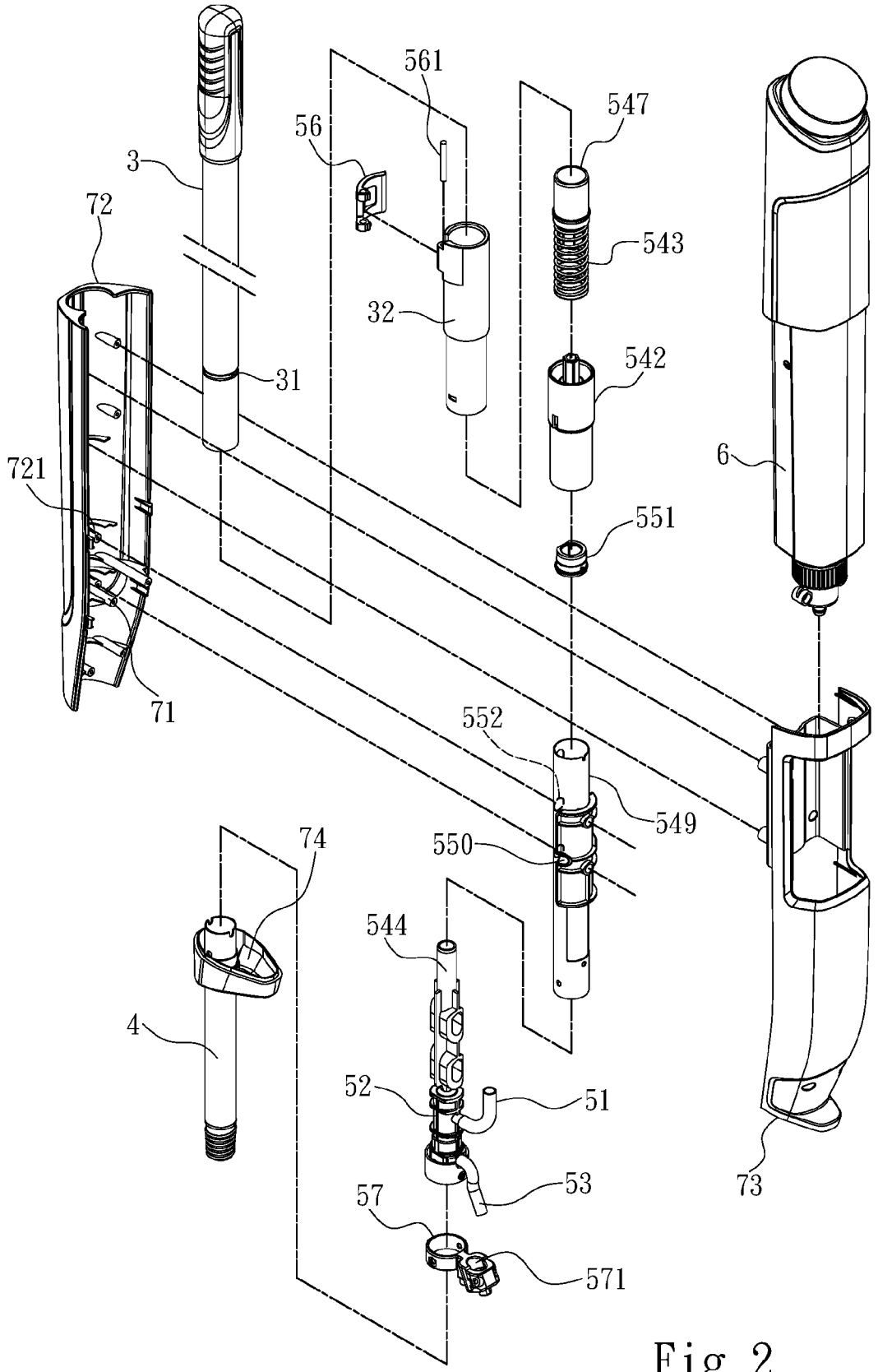
FIG. 2 is an exploded view according to an embodiment of the present invention.

Details and technical contents of the present invention are given with the accompanying drawings below.

Referring to FIG. 1 to FIG. 4, a dripping mop of the present invention includes a mop head 1 and a mop pole 2. The mop head 1 may overall appear as a flat plate, and includes at least one cleaning member (not shown). For example, the cleaning member may be a piece of cleaning cloth. The mop pole 2, assembled with the mop head 1, includes a holding rod 3, a connecting rod 4 assembled with the mop head 1, a dripping control assembly 5 connected between the holding rod 3 and the connecting rod 4, and a water tank 6 connected to the dripping control assembly 5 and storing a cleaning liquid.

The holding rod 3, the dripping control assembly 5 and the connecting rod 4 of the present invention are sequentially assembled along an axial direction. The holding rod 3 includes a recess 31 at a surface thereof. The recess 31 is provided at a partial area of the holding rod 3, and may be a trench surrounding the surface of the holding rod 3, for example, as shown 1. The dripping control assembly 5 of the present invention includes an inlet conduit 51 connected to the water tank 6, an outlet valve 52 connected to the inlet conduit 51, an outlet conduit 53 connected to the outlet valve 52, a dripping on/off switch 54 assembled with the holding rod 3 and corresponding to the outlet valve 52, and a dripping limiting switch 56 corresponding to the holding rod 3.

Further referring to FIG. 1 to FIG. 6, the dripping on/off switch 54 of the present invention is implemented by an alternating switching structure. In one embodiment, the dripping on/off switch 54 includes an upper tooth column 540, a lower tooth column 541 corresponding to the upper tooth column 540, a connecting sleeve 542 for accommodating the upper tooth column 540 and the lower tooth column 541, a restoration spring 543 in the connecting sleeve 542 and accommodated the upper tooth column 540 to drive the upper tooth column 540 to move, and a trigger rod 544 corresponding to the lower tooth column 541 and driven by the lower tooth column 541 to trigger the outlet valve 52. The upper tooth column 540 includes a ratchet structure at a side facing the lower tooth column 541, the lower tooth column 541 includes another ratchet structure at a side facing the upper tooth column 540, and the two ratchet structures engage with each other. Further, each of the upper tooth column 540 and the lower tooth column 541 includes a plurality of channels 545 at the side with the ratchet structure. The connecting sleeve 542 includes at least one guiding rib 546 at the inner edge thereof. The configuration of the guiding rib 546 corresponds to each of the channels 545 to allow the guiding rib 546 to enter each of the channels 545. In one embodiment, the dripping on/off switch 54 includes an installation seat 547 connected to the holding rod 3. In addition to being connected to the holding rod 3, the installation seat 547 further corresponds to the upper tooth column 540. The installation seat 547 includes a recessed region 548 at a side facing the upper tooth column 540 to allow the upper tooth column 540 to be placed in the recessed region 548. As such, when the holding rod 3 displaces towards the connecting rod 4, the upper tooth column 540 falls into the recessed region 548.

Figure 7:
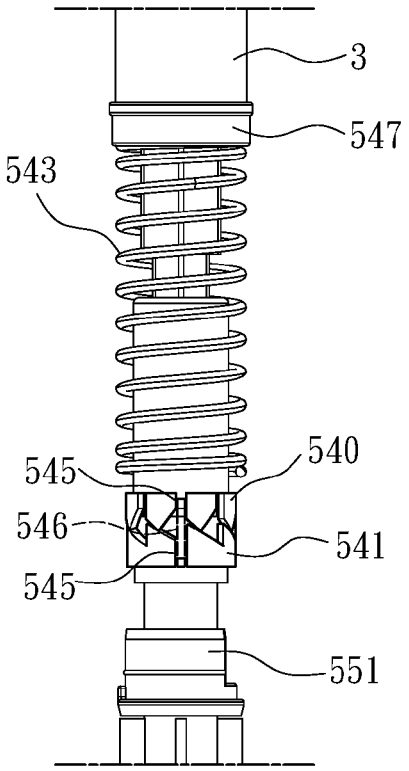
FIG. 7 is a first implementation schematic diagram of a dripping on/off switch according to an embodiment of the present invention.
Figure 8:
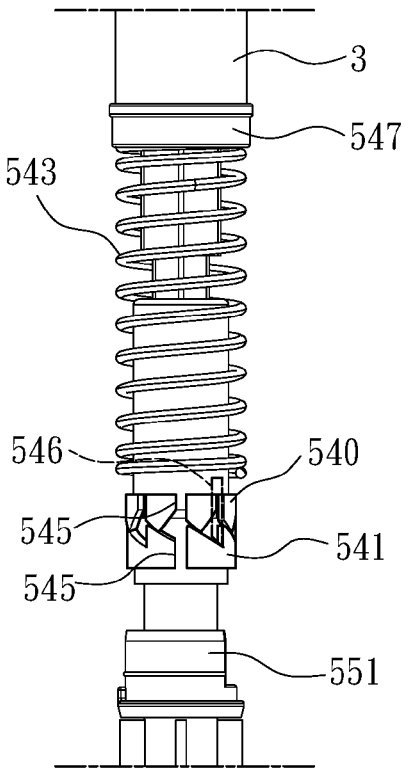
FIG. 8 is a second implementation schematic diagram of a dripping on/off switch according to an embodiment of the present invention.

Referring to FIG. 7 and FIG. 8, the dripping on/off switch 54 of the present invention has an on state and an off state. In the on state, the holding rod 3 receives a force and displaces towards the connecting rod 4 to trigger the outlet valve 52, such that the cleaning liquid is constantly provided for dripping through the outlet conduit 53. In the off state, the connecting rod 4 in the on state again receives a force and displaces towards the connecting rod 4 to close the outlet valve 52, such that the dripping is suspended. More specifically, while not yet applied for dripping, the dripping mop of the present invention initially receives a force, displaces towards the connecting rod 4 and drives the dripping on/off switch 54 to cause the upper tooth column 540 to drive the lower tooth column 541 to move. Thus, the guiding rib 546 slides on the lower tooth column 541 and drives the lower tooth column 541 to rotate by a pitch and abut against one tooth of the lower tooth column 541. The lower tooth column 541 then presses the trigger rod 544, such that the outlet valve 52 is pressed by the trigger rod 544 to change from being closed to being open. At this point, the inlet conduit 51 is in communication with the outlet conduit 53 to allow the cleaning liquid to flow from the inlet conduit 51 through the outlet valve 52 to the outlet conduit 53 for dripping. However, after entering the on state, the dripping mop of the present invention does not automatically change its state, and only changes from the on state to the off state when a user again causes the holding rod 3 to displace towards the connecting rod 4. That is to say, when the dripping on/off switch 54 is in the on state and causes the dripping mop to perform dripping, the holding rod 3 again receives a force, displaces towards the connecting rod 4 and drives the dripping on/off switch 54 to cause the upper tooth column 540 to again drive the lower tooth column 541 to move. Thus, the guiding rib 546 again slides on the lower tooth column 541 and drives the lower tooth column 541 to rotate by a pitch, such that the guiding rib 546 falls into one of the channels 545. The lower tooth column 541 then immediately stops pressing the trigger rod 544, such that the outlet valve 52 is no longer pressed by the trigger rod 544 and changes from being open to being closed. Thus, the cleaning liquid is restrained from flowing from the inlet conduit 51 to the outlet conduit 53, hence suspending the dripping.

Figure 9:
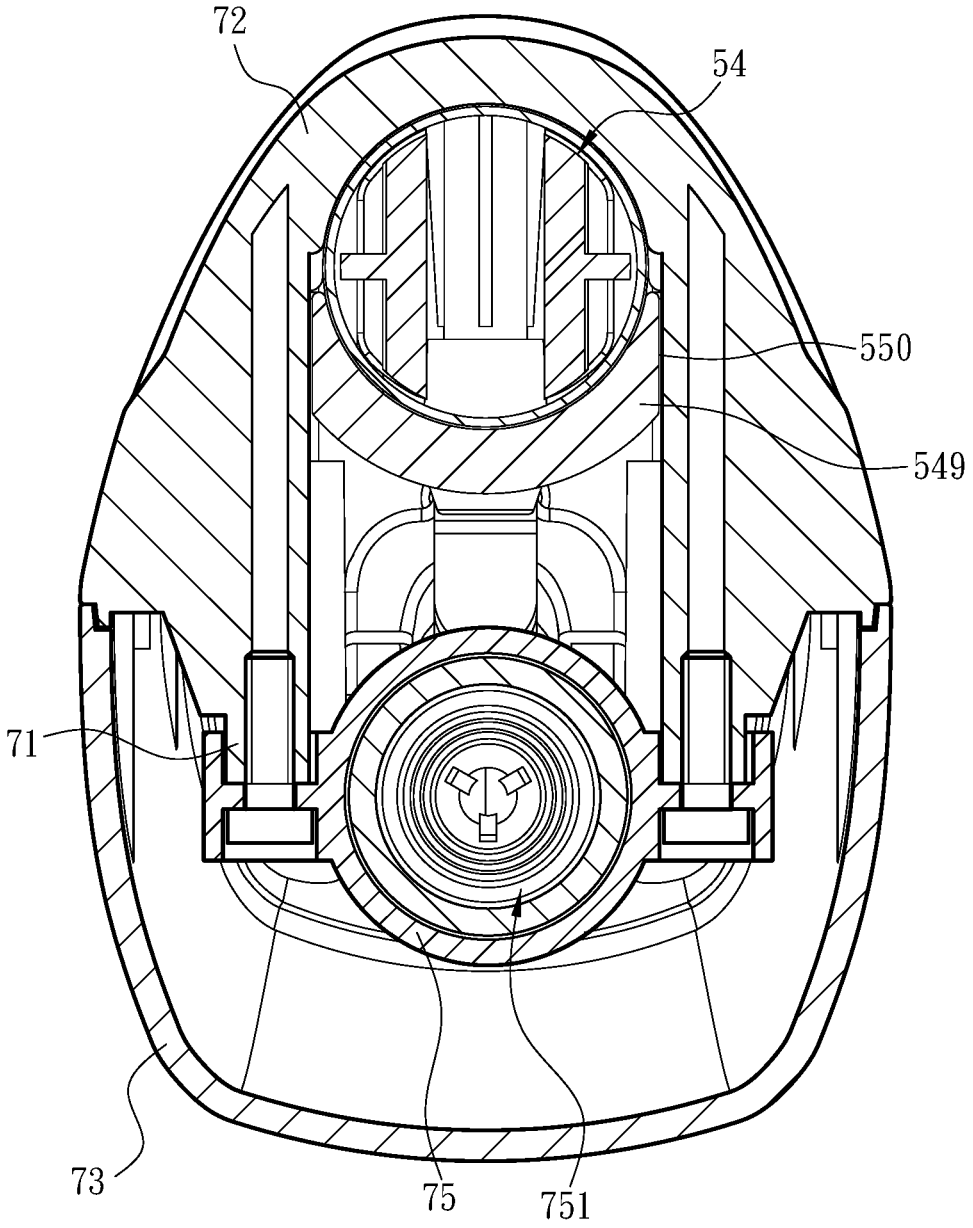
FIG. 9 is a third partial section view according to an embodiment of the present invention.

Again referring to FIG. 2 to FIG. 4, the dripping mop of the present invention further includes an outer housing 7. The outer housing 7 is disposed on the mop pole 2, and at least encloses the dripping on/off switch 54. Referring to FIG. 9, to securely fix the outer housing 7, the dripping on/off switch 54 of the present invention further includes an installation sleeve 549 corresponding to the trigger rod 544. The installation sleeve 549 includes a limiting groove 550 at each of two opposite sides thereof. An extension direction of the limiting grooves 550 is orthogonal to the axial direction of the mop pole 2. The outer housing 7 includes two limiting ribs 71 respectively corresponding to the limiting grooves 550 to restrain the mobility of the outer housing 7. An extension direction of the limiting ribs 71 is also orthogonal to the mop pole 2. Thus, when the limiting ribs 71 are respectively assembled with the limiting grooves 550, the outer housing 7 is limited and restrained from arbitrarily rotating relative to the mop pole 2. In one embodiment, the dripping on/off switch 54 includes a bridge ring 551 bridged between the connecting sleeve 542 and the installation sleeve 549.

Figure 4:
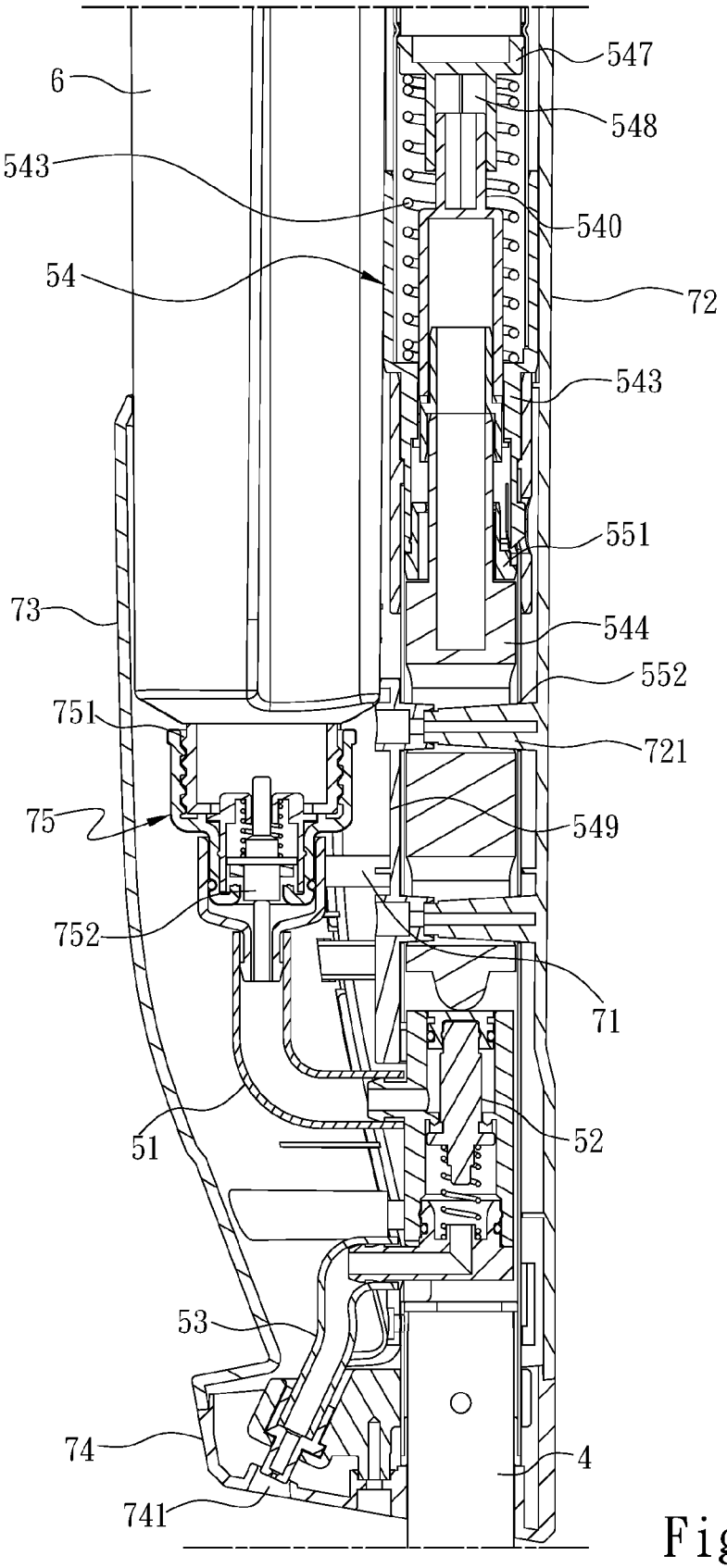
FIG. 4 is a second partial section view according to an embodiment of the present invention.
Figure 5:
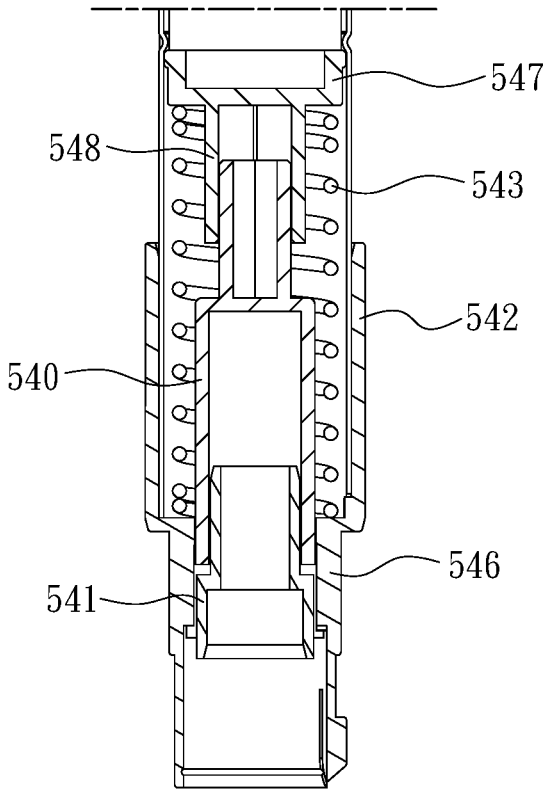
FIG. 5 is a partial section view of a dripping on/off switch according to an embodiment of the present invention.
Figure 6:
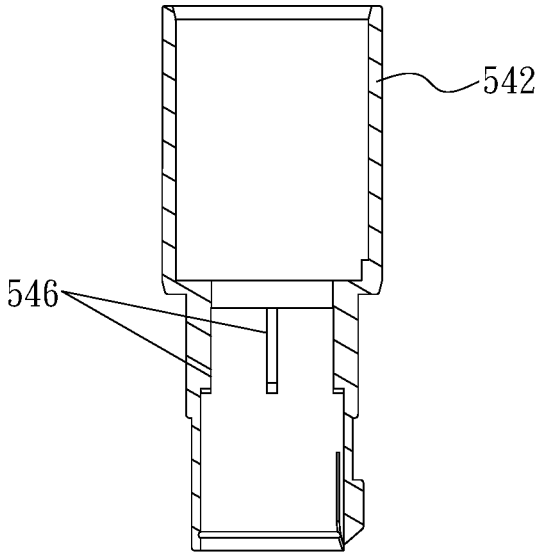
FIG. 6 is a section view of a connecting sleeve according to an embodiment of the present invention.

The outer housing 7 of the present invention may further include a first half housing 72, a second half housing 73 and a lower sealing half housing 74 assembled with one another. The two limiting ribs 71 are disposed in one of the first half housing 72 and the second half housing 73, and extend towards the other of the first half housing 72 and the second half housing 73. For example, when the two limiting ribs 71 are disposed in the first half housing 72, the two limiting ribs 71 extend from the first half housing 72 towards the second half housing 73. It should be noted that, the two limiting ribs 71 do not simultaneously in come into contact with the first half housing 72 and the second half housing 73 after they are formed. In other words, the two limiting ribs 71 only extend from the first half housing 72 towards the second half housing 73 without coining into contact with the second half housing 73. Further, the lower sealing half housing 74 is assembled with both of the first half housing 72 and the second half housing 73, and is located at a relatively lower end of the first half housing 72 and the second half housing 73, as shown in FIG. 1 and FIG. 4. Further, the lower sealing half housing 74 includes a through hole 741 for disposing the outlet conduit 53 therein. Further, to install the outer housing 7 on the mop pole 2, the installation sleeve 549 is provided with at least one installation hole 552, and the first half housing 72 is provided with at least one installation pillar 721. The number of the installation pillar 721 corresponds to the number of the installation hole 552. Thus, the first half housing 72 may be fixed on the dripping on/off switch 54 of the mop pole 2 by installing the installation pillar 721 in the installation hole 552. Using a plurality of screws, the first half housing 72, the second half housing 73 and the lower sealing half housing 74 may be assembled with one another to complete the installation of the outer housing 7.

Figure 3:
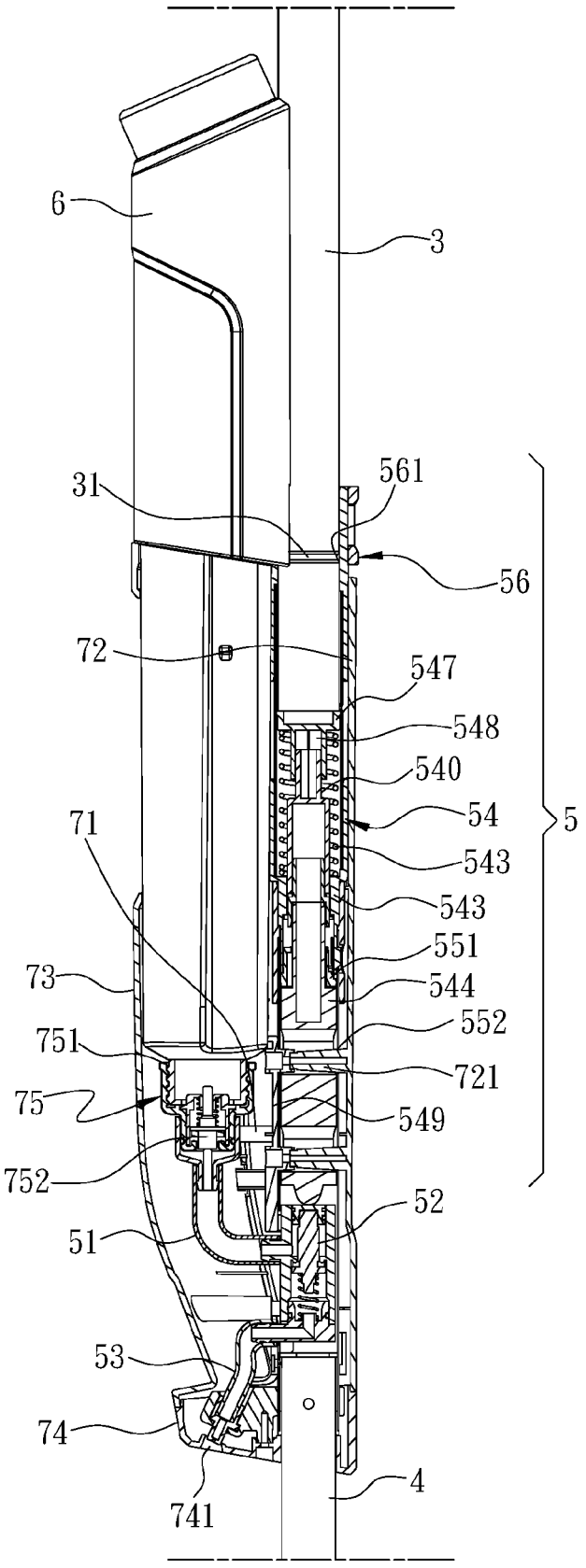
FIG. 3 is a first partial section view according to an embodiment of the present invention.

Referring to FIG. 3 and FIG. 4, the outer housing 7 includes a tank seat 75, which is assembled with the two limiting ribs 71 and assembled with one end of the inlet conduit 51. The tank seat 75 allows the water tank 6 to be selectively assembled thereon, and includes an accommodating chamber 751 for disposing an outlet end of the water tank 6. One end of the inlet conduit 51 fixed on the tank seat 75 is further located in the accommodating chamber 751, such that the inlet conduit 51 is in communication with an internal space of the accommodating chamber 751. Thus, when the outlet end of the water tank 6 is disposed in the accommodating chamber 751, the cleaning liquid stored in the water tank 6 may flow into the inlet conduit 51. The outer housing 7 may further include a supply valve 752 provided on the tank seat 75. The supply valve 752 is in the accommodating chamber 751 and is in connected to the inlet conduit 51 to determine whether to allow the accommodating chamber 751 to be in communication with the inlet conduit 51. More specifically, when the outlet end of the water tank 6 is not placed in the accommodating chamber 751, the supply valve 752 separates the internal space of the accommodating chamber 751 from the inlet conduit 51. When the outlet end of the water tank 6 is placed in the accommodating chamber 751, the supply valve 752 is pressed by the outlet end of the water tank 6 to become open to further cause the internal space of the accommodating chamber 751 to be in communication with the inlet conduit 51.

In one embodiment, the dripping control assembly 5 further includes an adaptor 57 bridged between the connecting rod 4 and the outlet valve 52. The adaptor 57 includes a guiding channel 571 deviating from the axial direction of the mop pole 2, extending towards the mop head 1 and allowing the outlet conduit 53 to be disposed therein. An inclined level of the guiding channel 571 may be designed according to actual application requirements.

Figure 10:
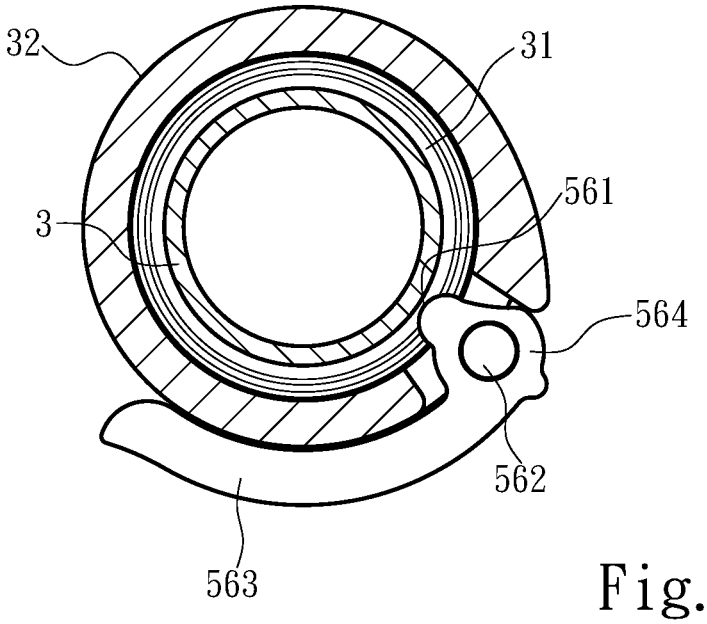
FIG. 10 is a first implementation schematic diagram of a dripping limiting switch according to an embodiment of the present invention.
Figure 11:
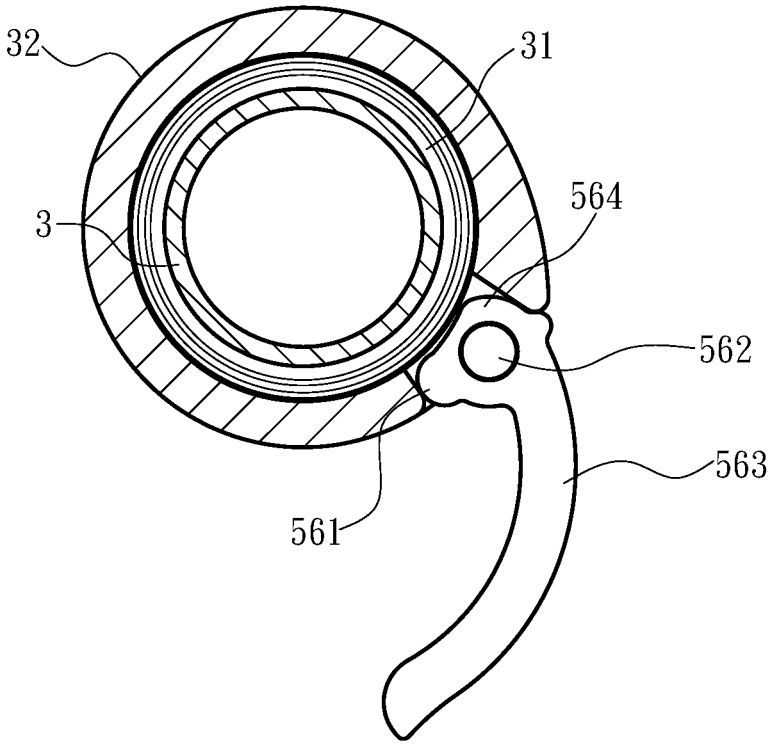
FIG. 11 is a second implementation schematic diagram of a dripping limiting switch according to an embodiment of the present invention.

Referring to FIG. 10 and FIG. 11, the dripping limiting switch 56 of the present invention is disposed correspondingly to the recess 31 of the holding rod 3, is rotatable relative to the holding rod 3, and includes a protrusion 561 corresponding to the recess 31. Further, the mop pole 2 includes a pivoting sleeve 32 accommodating the holding rod 3 and corresponding to the recess 31. The pivoting sleeve 32 allows the dripping limiting switch 56 to be pivotally connected thereto using a pivot axis 562. The configuration of the part of the pivoting sleeve 32 for pivotally connecting the dripping limiting switch 56 may be designed according to the configuration of the dripping limiting switch 56. On the other hand, the dripping limiting switch 56 includes a lever member 563 and a pivot member 564. The pivot member 564 is connected to the lever member 563, forms a pivotal connection with the pivoting sleeve 32, and includes the protrusion 561. The protrusion 561 noticeably protrudes from the surface of the pivot member 564, and falls in the recess 31 of the holding rod 3 when the pivot member 564 rotates relative to the holding rod 3. As the protrusion 561 falls in the recess 31, the holding rod 3 is restrained from displacing towards the connecting rod 4 to further prohibit the dripping mop of the present invention to perform dripping. Further, when the pivot member 564 pivotally rotates relative to the holding rod 3, the protrusion 561 displaces along the axial direction of the mop pole 2. In one embodiment, the protrusion 561 is a protruding point adapted to fall into the surrounding trench, as shown in FIG. 4.

In an initial stage of applying the dripping mop of the present invention, the displacement restraint that the dripping limiting switch 56 applies on the holding rod 3 is released, and a force is then applied to the holding rod 3 to cause the dripping on/off switch 54 to enter the on state to allow the dripping mop to perform dripping. After cleaning, a force is again applied to the holding rod 3 to cause the dripping on/off switch 54 to change from the on state to the off state to stop dripping.

What is claimed is:

1. A dripping mop, comprising:

a mop head; and a mop pole, comprising a holding rod, a connecting rod assembled with the mop head, a dripping control assembly connected between the holding rod and the connecting rod, and a water tank connected to the dripping control assembly and storing a cleaning liquid;

wherein, the holding rod comprises a recess at a surface thereof, the dripping control assembly comprises an inlet conduit connected to the water tank, an outlet valve connected to the inlet conduit, an outlet conduit connected to the outlet valve, a dripping on/off switch assembled with the holding rod and corresponding to the outlet valve, and a dripping limiting switch corresponding to the holding rod, the dripping on/off switch has an on state, in which the holding rod receives a force and displaces towards the connecting rod to trigger the outlet valve, such that the cleaning liquid is constantly provided for dripping through the outlet conduit, and an off state, in which the holding rod in the on state again receives a force and displaces towards the connecting rod to close the outlet valve, such that the dripping is suspended, the dripping limiting switch is rotatable relative to the holding rod and comprises a protrusion corresponding to the recess, and the protrusion restrains the holding rod from displacing towards the connecting rod when the protrusion falls in the recess.

2. The dripping mop of claim 1, wherein the dripping on/off switch comprises an upper tooth column, a lower tooth column corresponding to the upper tooth column, a connecting sleeve for accommodating the upper tooth column and the lower tooth column, a restoration spring in the connecting sleeve and accommodated the upper tooth column to drive the upper tooth column to move, and a trigger rod corresponding to the lower tooth column and driven by the lower tooth column to trigger the outlet valve, each of the upper tooth column and the lower tooth column comprises a plurality of channels spaced from one another, the connecting sleeve comprises at least one guiding rib at an inner edge thereof, and the guiding rib rotates the lower tooth column to fall in one of the channels or abuts against the lower tooth column when the upper tooth column drives the lower tooth column to move to cause the dripping on/off switch to enter the on state or the off state.

3. The dripping mop of claim 2, wherein the dripping on/off switch comprises an installation seat connected to the holding rod, and the installation seat comprises a recessed region at one side facing the upper tooth column for the upper tooth column to be placed therein.

4. The dripping mop of claim 2, further comprising an outer housing on the mop pole and at least enclosing the dripping on/off switch.

5. The dripping mop of claim 4, wherein the dripping on/off switch comprises an installation sleeve corresponding to the trigger rod, the installation sleeve comprises a limiting groove at each of two opposite sides thereof, an extension direction of the limiting grooves is orthogonal to an axial direction of the mop pole, and the outer housing comprises two limiting ribs respectively corresponding to the limiting grooves to restrain mobility of the outer housing.

6. The dripping mop of claim 5, wherein the outer housing comprises a first half housing, a second half housing and a lower sealing half housing, the two limiting ribs are disposed in one of the first half housing and the second half housing and extend towards the other of the first half housing and the second half housing, and the lower sealing half housing comprises a through hole for disposing the outlet conduit therein.

7. The dripping mop of claim 5, wherein the dripping on/off switch comprises a bridge ring bridged between the connecting sleeve and the installation sleeve.

8. The dripping mop of claim 5, wherein the dripping control assembly comprises an adaptor bridged between the connecting rod and the outlet valve, and the adaptor comprises a guiding channel deviating from the axial direction of the mop pole, extending towards the mop head and allowing the outlet conduit to be disposed therein.

9. The dripping mop of claim 5, wherein the outer housing comprises a tank seat assembled with the two limiting ribs and assembled with one end of the inlet conduit.

10. The dripping mop of claim 9, wherein the outer housing comprises a supply valve provided on the tank seat.

11. The dripping mop of claim 10, wherein the recess is a trench surrounding the surface of the holding rod, and the protrusion is a protruding point adapted to fall in the surrounding trench.

12. The dripping mop of claim 4, wherein the mop pole comprises a pivoting sleeve accommodating the holding rod and corresponding to the recess, the dripping limiting switch is pivotally connected on the pivoting sleeve and comprises a lever member and a pivot member, and the pivot member is connected to the lever member, forms a pivotal connection with the pivoting sleeve, and comprises the protrusion.

13. The dripping mop of claim 1, wherein the recess is a trench surrounding the surface of the holding rod, and the protrusion is a protruding point adapted to fall in the surrounding trench.

* * * * *